United States Patent [19]

Cole et al.

[11] 4,348,953

[45] Sep. 14, 1982

[54] CONTINUOUS STENCIL ASSEMBLY AND METHOD OF MANUFACTURING IT

[75] Inventors: Jean R. Cole, Carterville; Raymond R. Panaia, Carbondale, both of Ill.

[73] Assignee: Diagraph-Bradley Industries, Inc., Herrin, Ill.

[21] Appl. No.: 222,179

[22] Filed: Jan. 2, 1981

[51] Int. Cl.[3] ..... B41N 1/24; B41C 1/14

[52] U.S. Cl. ..... 101/128.21; 101/128.4

[58] Field of Search ..... 101/127–128.4; 270/52–53; 282/12 A; 229/69

[56] References Cited

U.S. PATENT DOCUMENTS

| | | | |
|---|---|---|---|
| 1,707,095 | 3/1929 | Pyle . | |
| 1,909,913 | 5/1933 | Elliott . | |
| 2,790,382 | 4/1957 | Parslow | 101/128.21 |
| 2,875,687 | 3/1959 | Renauer | 101/149.4 |
| 2,970,931 | 2/1961 | Gumbinner | 117/35.5 |
| 3,052,284 | 9/1962 | Weber et al. | 156/542 |
| 3,162,116 | 12/1964 | Weber | 101/128.1 |
| 3,457,856 | 7/1969 | Rydberg et al. | 101/128.2 |
| 3,768,801 | 10/1973 | Maynard | 270/53 |
| 3,786,748 | 1/1974 | Rabelow | 101/128.2 |
| 3,789,756 | 2/1974 | Weber | 101/128.2 |
| 3,830,141 | 8/1974 | Steidinger | 270/53 X |
| 3,897,727 | 8/1975 | Fulk | 270/52 X |

*Primary Examiner*—Richard J. Apley
*Assistant Examiner*—A. Heinz
*Attorney, Agent, or Firm*—Senniger, Powers, Leavitt and Roedel

[57] ABSTRACT

A continuous stencil assembly comprising a continuous strip of stencil material on a continuous carrier strip, the assembly having lines of perforations dividing it into individual stencil assemblies each comprising a stencil sheet on a carrier sheet, the continuous assembly being adapted to be torn into the individual assemblies after typing thereon, each individual assembly being adapted to be clamped to an imprinting device such as a hand-printer and having a line of weakness in the carrier sheet for tearing it off, and a method of manufacturing the continuous assembly.

13 Claims, 12 Drawing Figures

CONTINUOUS STENCIL ASSEMBLY AND METHOD OF MANUFACTURING IT

BACKGROUND OF THE INVENTION

This invention relates to continuous stencil assemblies, and to methods for the manufacture thereof.

Reference may be made to U.S. Pat. No. 3,052,284 issued Sept. 4, 1962 showing a continuous stencil assembly comprising a continuous carrier strip (13) having transverse lines of perforations (185) spaced at equal intervals along its length dividing it into individual "business forms" and having holes (53) at its side margins for receiving pins for feeding it. Each individual "business form" (each portion of strip 13 between successive lines of perforations) has a stencil (187) adhered thereto (at 188). The continuous carrier strip with the stencils thereon is adapted to be fed through a typewriter for being typed to impress each stencil, usually with a name and address, and simultaneously to imprint the strip (13), as by means of a carbon sheet or carbon coating on the back of the stencil, after which the stencil may be removed from the strip and applied to an imprinting device, e.g., a so-called handprinter such as shown in U.S. Pat. No. 2,765,737, for stencilling the name and address on packages. Aside from possible problems in high-speed production of the said continuous strip with the stencils spaced at intervals along the length of the strip, there is the problem that the stencils, once removed from the strip, are difficult to apply to the imprinting device (e.g., a handprinter) since they are inherently per se quite flimsy, making them per se difficult to handle.

SUMMARY OF THE INVENTION

Among the several objects of the invention may be noted the provision of an improved continuous stencil assembly which, while being adapted to be fed through a standard typewriter or special impressing device for impressing the stencils, enables each stencil more readily to be handled for application to an imprinting implement such as a handprinter or label printer; and the provision of a method of manufacturing such continuous stencil assemblies at relatively high speed.

In general, a continuous stencil assembly of this invention comprises a continuous stencil strip of stencil material and a continuous carrier strip carrying the stencil strip, the stencil strip extending longitudinally of the carrier strip on one face of the carrier strip. The strips have a first series of lines of weakness extending transversely thereof spaced at stencil height intervals along their length with each of the lines of weakness of the first series in the stencil strip at least generally in register with a respective line of weakness of the first series in the carrier strip. The strips are adapted to be torn on the lines of weakness of the first series for providing individual stencil assemblies each comprising the segment of the stencil strip and the segment of the carrier strip between two successive lines of weakness of the first series. The carrier strip further has a second series of lines of weakness extending transversely thereof spaced at intervals corresponding to the spacing of the lines of weakness of the first series but offset longitudinally of the strips from the lines of weakness of the first series. Each line of weakness of the second series is adjacent one of the two successive lines of weakness of said first series in the carrier strip and between said two successive lines of weakness of said first series in the carrier strip. Each individual stencil assembly, as torn from said continuous stencil assemby on the respective two successive lines of weakness of said first series, is of rectangular shape having transverse edges where torn at said two successive lines of weakness of the first series and end edges, and having a line of weakness of the second series in the segment of the carrier strip in said individual stencil assembly adjacent one of said transverse edges. Means is provided for securing the stencil strip to the carrier strip and holds the said segments of the strips in each of said individual stencil assemblies together but with a portion of the carrier strip between the said line of weakness of the second series therein and the other of said transverse edges free of the segment of the stencil strip in the individual stencil assembly. This construction permits securement to an imprinter of each individual stencil assembly along said one transverse edge thereof including both the carrier strip segment and the stencil strip segment of the individual stencil assembly and subsequent tearing away of the free portion of the carrier strip segment, leaving a portion of the carrier strip segment along said one transverse edge secured to the imprinter.

The method of making the continuous stencil assembly generally comprises feeding forward from respective supplies thereof the continuous stencil strip and the continuous carrier strip, bringing these strips together with the stencil strip extending longitudinally along the carrier strip on one face of the carrier strip, forming lines of weakness in the carrier strip as it is fed forward toward the stencil strip with these lines of weakness extending transversely of the carrier strip and spaced at stencil height intervals along the length of the carrier strip, these lines constituting the stated second series of lines of weakness, and forming lines of weakness in the combined stencil and carrier strips with these lines extending transversely of the strips and also spaced at stencil height intervals but offset longitudinally from the lines of weakness of said second series in the carrier strip and constituting the stated said first series of lines of weakness, the stencil strip being secured to the carrier strip in the manner specified above as the strips are brought together.

Other objects and features will be in part apparent and in part pointed out hereinafter.

BRIEF DESCRIPTION OF THE DRAWINGS

Corresponding reference characters indicate corresponding parts throughout several views of the drawings.

DESCRIPTION OF THE PREFERRED EMBODIMENT

Figure 1:
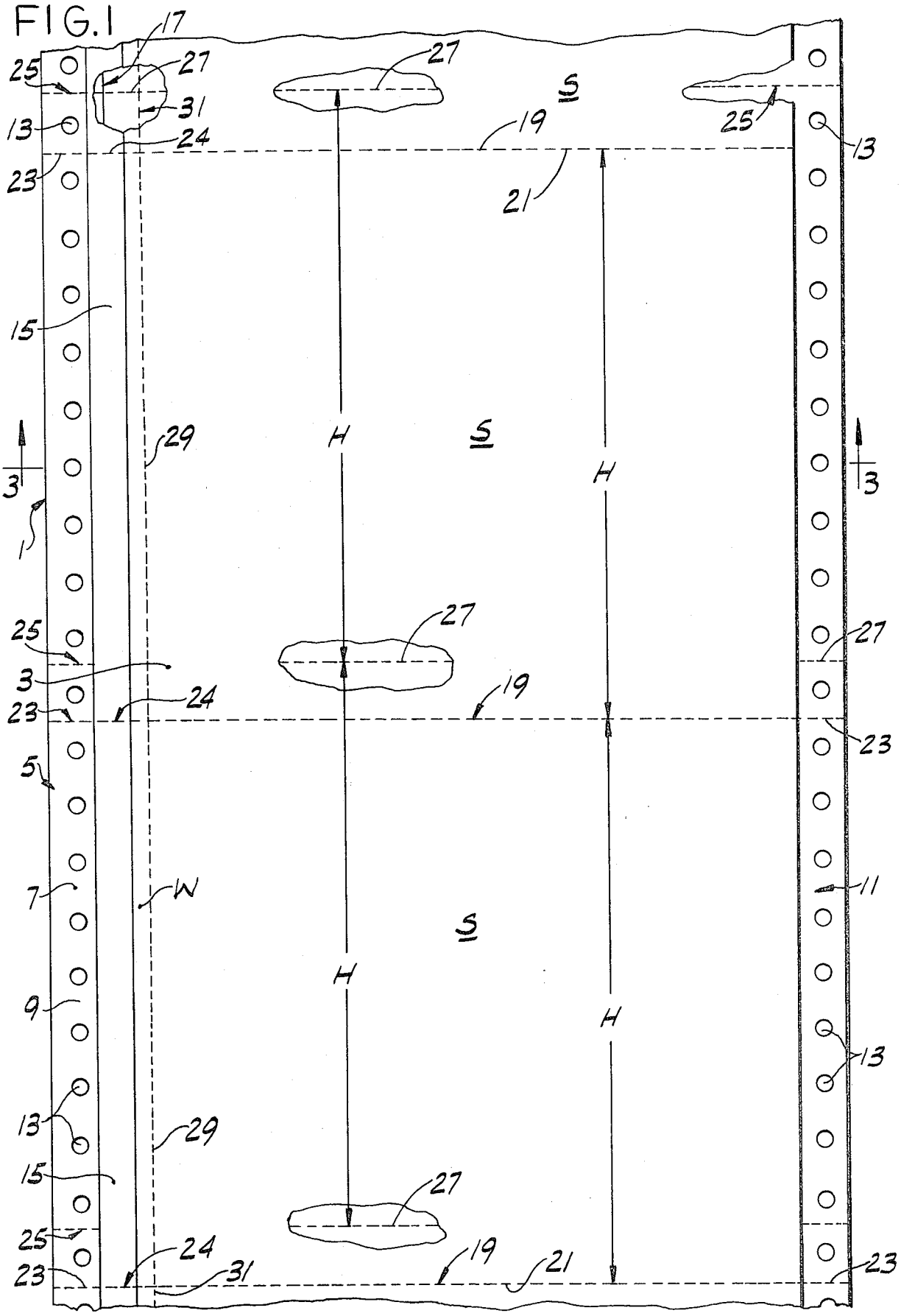
FIG. 1 is a view in elevation of one face of a portion of the length of a continuous stencil assembly of this invention, with parts of a stencil strip of the assembly broken away to show underlying detail.
Figure 2:
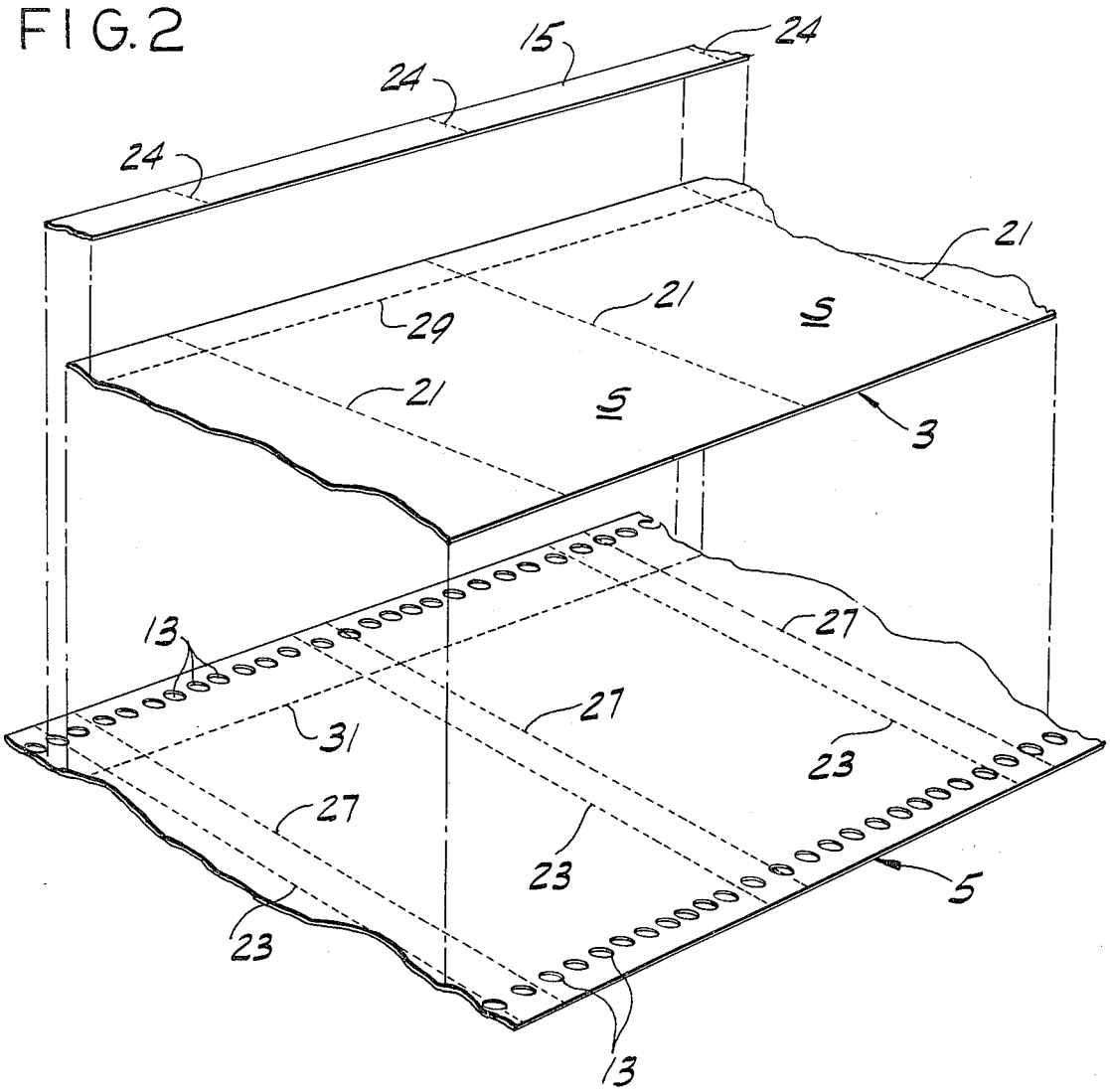
FIG. 2 is an exploded view showing components of the FIG. 1 assembly.
Figure 3:
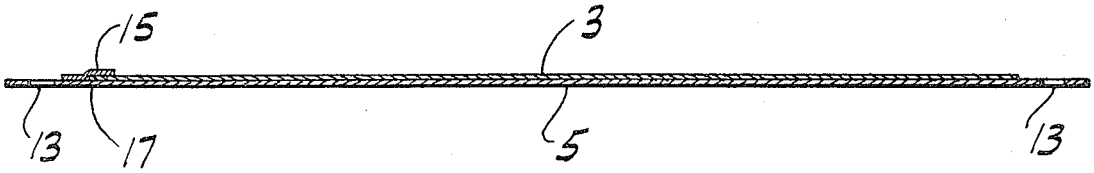
FIG. 3 is a transverse section of the FIG. 1 assembly on line 3—3 of FIG. 1.
Figure 3A:
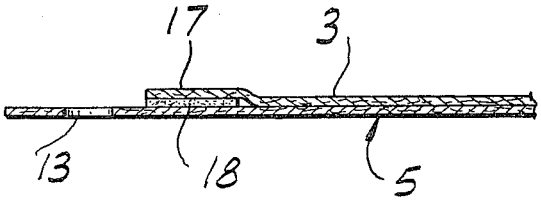
FIG. 3A is a view similar to the left-hand part of FIG. 3 and on a larger scale, showing a modification.

Referring first to FIGS. 1–3 of the drawings, a continuous stencil assembly of this invention, designated in its entirety by the reference numeral 1, is shown to comprise a continuous stencil strip 3 of stencil material, and a continuous carrier strip 5 carrying the stencil strip 3. The stencil strip 3 may be a strip of any conventional stencil material such as has been and is presently widely used, generally comprising a tissue having a coating which, when the tissue is imprinted under pressure with names, addresses etc. as by means of a computer printer or typewriter, is rendered pervious to ink where imprinted for its use as a stencil to print the names, addresses etc. on surfaces to be printed. This types of stencil material is quite flimsy, making it difficult to handle per se. The carrier strip 5 may be a strip of any suitable paper, and is generally a strip of paper which is stiffer than the stencil tissue. The continuous stencil strip 3 extends longitudinally of the carrier strip 5 on one face 7 of the carrier strip, the stencil strip being narrower than the carrier strip, the side margins 9 and 11 of the carrier strip extending laterally outwardly from under the stencil strip at both sides of the stencil strip. Each of these side margins 9 and 11 of the carrier strip has a series of holes 13 therein extending longitudinally of the carrier strip adapted to receive pins (not shown) of a feed device in a computer printer or other suitable impressing device, for feeding the assembly through the printer or other suitable impressing device for imprinting the stencil strip. The stencil strip 3 is secured to the carrier strip 5 by means of a relatively narrow strip of adhesive tape 15, such as a pressure-sensitive adhesive tape, overlying and adhered to the stencil strip 3 along one margin 17 of the stencil strip (its left-hand margin as viewed in FIGS. 1 and 3) and overlying and adhered to the carrier strip 5 immediately outward of the respective edge of the stencil strip and inward of the respective series of holes (so as not to cover the holes). Alternatively, the stencil strip may be secured to the carrier strip by adhesive as indicated at 18 in FIG. 3A between the margin 17 of the stencil strip and the carrier strip.

The stencil strip 3, the carrier strip 5 and the tape 15 (or adhesive 18) have a first series of lines of weakness extending transversely thereof spaced at stencil height intervals H along the length of the strips and the tape, with each of the lines of weakness of this first series in the stencil strip and tape at least generally in register with a respective line of weakness of this first series in the carrier strip. The first series is generally designated 19, the lines of weakness of this series in the stencil strip are each designated 21, and the lines of weakness of this series in the carrier strips are each designated 23. In the preferred mode, the lines of weakness are lines of perforations. They cross the tape (or adhesive) at 24. The strips are adapted to be torn on the lines of weakness 21, 23 and 24 of the first series 19 into individual stencil assemblies S, each comprising the segments of the carrier strip 5 and stencil strip 3 between two successive sets of lines of weakness 21, 23 and 24 of the first series (as permitted by the lines 21, 23 and 24 of each set being in register or generally in register).

The carrier strip 5 further has a second series of lines of weakness extending transversely thereof spaced at intervals corresponding to the spacing of the sets of lines of weakness 21 and 23 of the first series 19, but offset longitudinally of the strips 3 and 5 from the lines of weakness of the first series. This second series is generally designated 25, the lines of weakness in this series (which are in the carrer strip only, not the stencil strip) are each designated 27, and in the preferred mode these lines of weakness are lines of perforations. Each line 27 is adjacent one of two successive lines 23 in the carrier strip and between said two successive lines 23.

In addition to the aforesaid set 19 of transverse lines of weakness, the stencil strip 3 and the carrier strip 5 each has a line of weakness, preferably a line of perforations, extending longitudinally thereof spaced inwardly adjacent the tape 15 (or adhesive 18), i.e. on the inside of the tape 15 (or adhesive 18). The longitudinal line of weakness in the stencil strip 3 is designated 29 and the longitudinal line of weakness in the carrier strip is designated 31. These lines are in register or at least generally in register. They permit tearing away as waste of the portions indicated at W of the stencil strip 3 and carrier strip 5 of an individual stencil assembly S which lie outward thereof.

Figure 4:
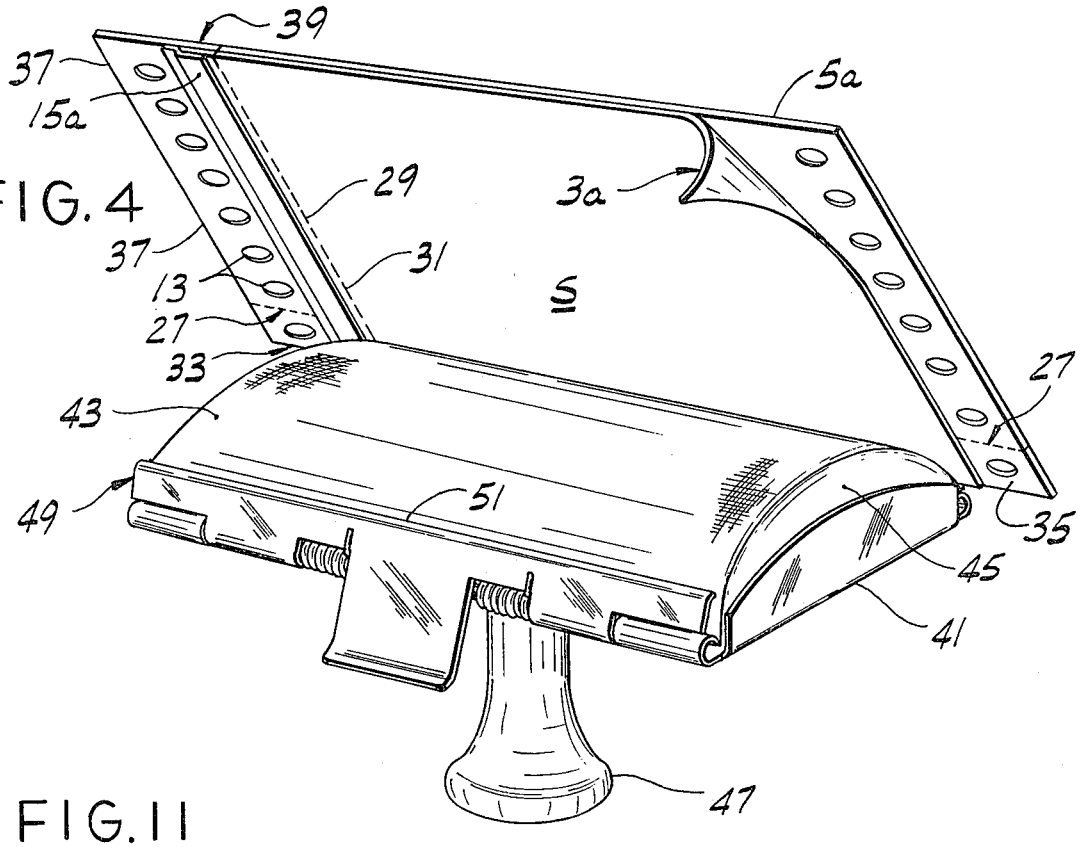
FIG. 4 is a perspective showing an individual stencil assembly torn from the FIG. 1 continuous stencil assembly as initially applied to a handprinter.

The continuous stencil assembly 1 is adapted to feed through a computer printer or typewriter or other suitable device for impressing the stencils, i.e. for imprinting a name and address, for example, on each segment of the stencil strip 3 between two successive sets of lines of weakness 21, 23, 24 of the first series 19 of lines of weakness. Then, the continuous stencil assembly is adapted to be torn on the lines of weakness 21, 23 and 24 into the individual stencil assemblies S, each comprising the segments of the carrier strip 5 and the stencil strip 3 between two successive sets of lines of weakness 21, 23, 24 of the first series 19. One of the stencil assemblies S is shown being applied to a conventional handprinter in FIG. 4. As shown therein the assembly S is of rectangular shape having transverse edges (its upper and lower edges as viewed in FIG. 4) where torn at the two successive lines of weakness of the first series, and having end edges (its right and left end edges as viewed in FIG. 4). It comprises a stencil strip segment **3*a* held on a carrier strip segment 5*a* by a tape segment 15*a*. The carrier strip segment has a line of weakness 27 extending transversely across the strip from one side to the other adjacent one of the transverse edges of the assembly, this edge being designated 33 (and being the result of tearing the continuous stencil assembly) on a set of lines of weakness 21, 23, 24. The transverse margin of the individual stencil assembly S between line 27 and edge 33 is designated 35. The stencil strip and carrier strip have the registering lines of weakness 29 and 31 extending heightwise of the assembly S from top to bottom adjacent one side edge of the assembly, this side edge being at the left as shown in FIG. 4 and designated 37. The tape segment 15*a* extends between this side 37 of the assembly S and the set of lines 29 and 31, and the side margin of the assembly between this set of lines and side edge 37 is designated 39. The portion of the carrier strip between line 27 and the transverse edge 39 (and between tape segment 15*a* and the right edge of the carrier strip) is free of stencil strip segment 3*a***.

Figure 5:
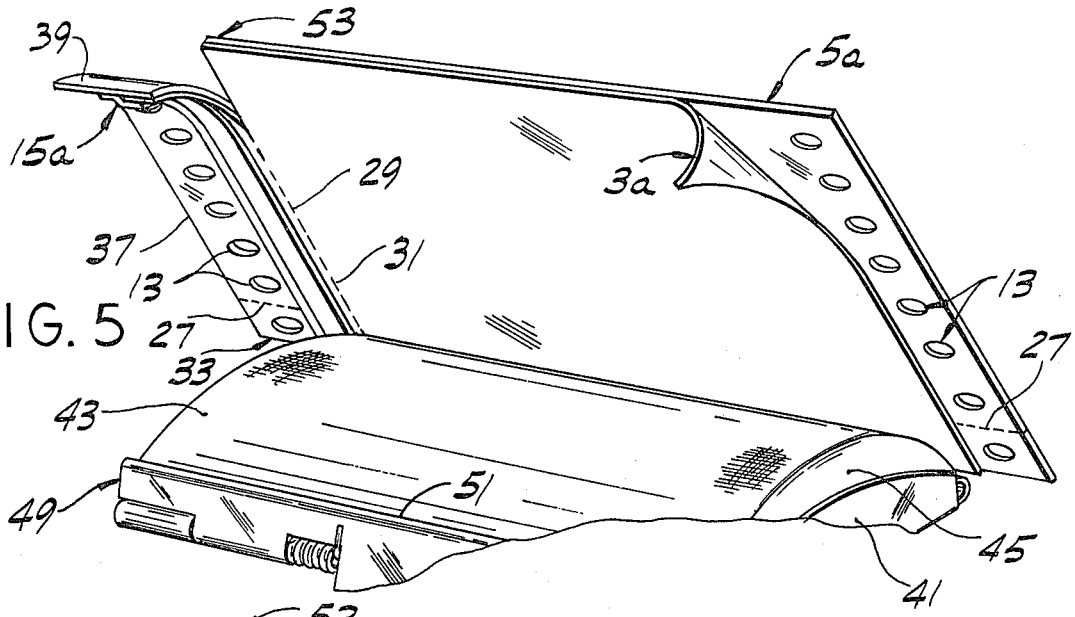
FIGS. 5–7 are views similar to FIG. 4 showing how portions of the individual stencil assembly are torn off and the stencil prepared for use on the handprinter.
Figure 6:
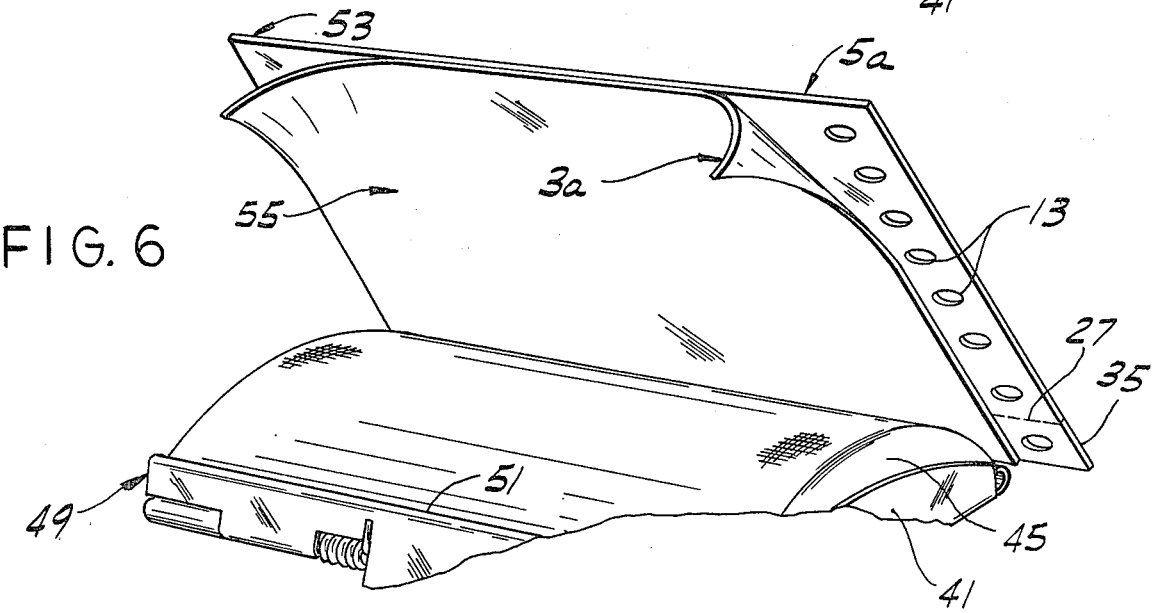
Figure 7:
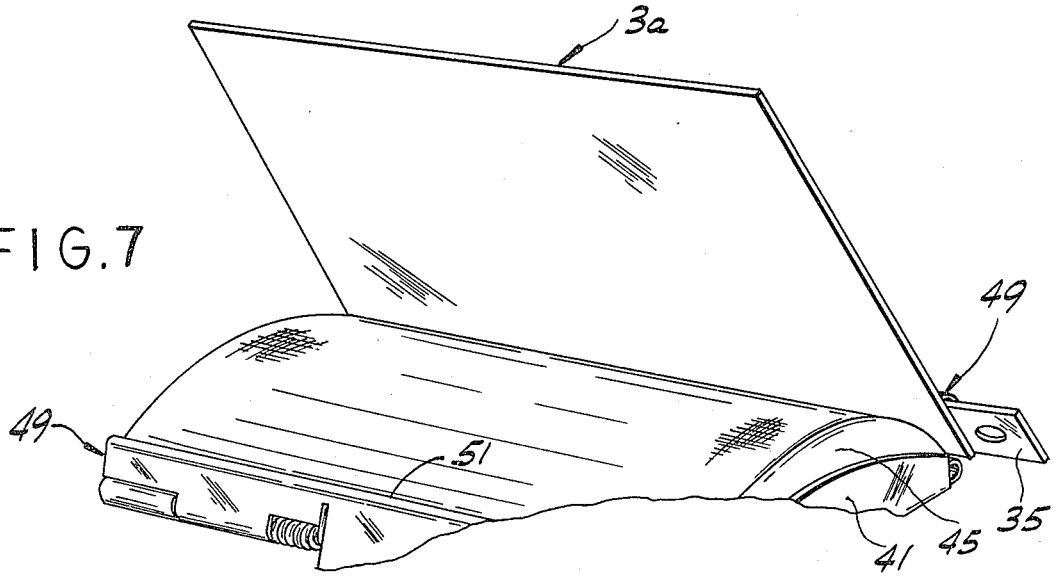

The handprinter, which is designated 41 in FIG. 4, generally comprises a convex inking pad 43 on an ink reservoir 45 having a handle 47 (which is removable for filling the reservoir with ink) and having spring stencil clamps such as indicated at 49 at opposite sides of the reservoir and the pad (only one of these clamps appears in FIG. 4). As shown in FIG. 4, an assembly S (stencil sheet 3*a* backed by carrier sheet 5*a*) is applied to the handprinter by clamping the margin 35 (along the lower edge of the assembly) to the handprinter by means of one of the clamps 49 with the line of weakness 27 in the carrier sheet closely adjacent but outside the lip of the clamp. The lip of each clamp is indicated at 51. This is readily effected, even though the stencil sheet 3*a* is per se flimsy, by reason of the stencil sheet being backed by the relatively stiff carrier sheet 5*a*. As illustrated, the assembly is applied to the handprinter with the carrier sheet 5*a* away from and the stencil sheet 3*a* toward the pad (i.e., with 3*a* on the inside). Then, as shown in FIGS. 5 and 6, the margin 39 of the assembly outward of the set of lines of weakness 29 and 31 is torn off. Then the pad 43 and the assembly (3*a* and 5*a*) are lightly pressed down on a flat surface (any available flat surface will do) and may be rolled on the flat surface. This causes the stencil sheet 3*a* (which lies against the pad) to stick to the pad by reason of the viscosity of ink on the pad, whereby the stencil sheet and carrier sheet become separated. It then becomes a simple matter to grasp the carrier sheet 5*a* and tear it off along the line of weakness 27, leaving only the stencil sheet 3*a* (and the remaining portion at 35 of the carrier sheet) clamped to the pad. Then, the other clamp 49, the one toward the viewer in FIG. 7, may be opened and the torn-off carrier sheet 5*a* used to tuck the margin of the stencil sheet 3*a* toward the viewer in FIG. 7 in under the clamp and the clamp closed on the margin, whereby the stencil sheet 3*a* is clamped at both its transverse margins in place on the ink pad 43. In this manner the stencil sheet, even though it is flimsy, is easily and cleanly applied to the handprinter.

Figure 8:
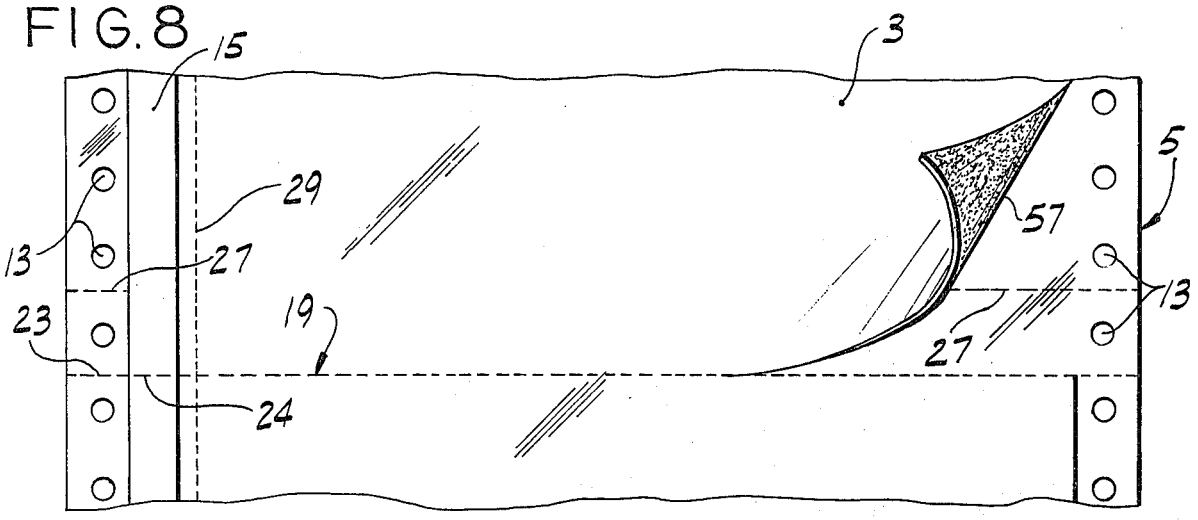
FIGS. 8–10 are views similar to FIG. 1 showing modifications of the continuous stencil assembly.
Figure 9:
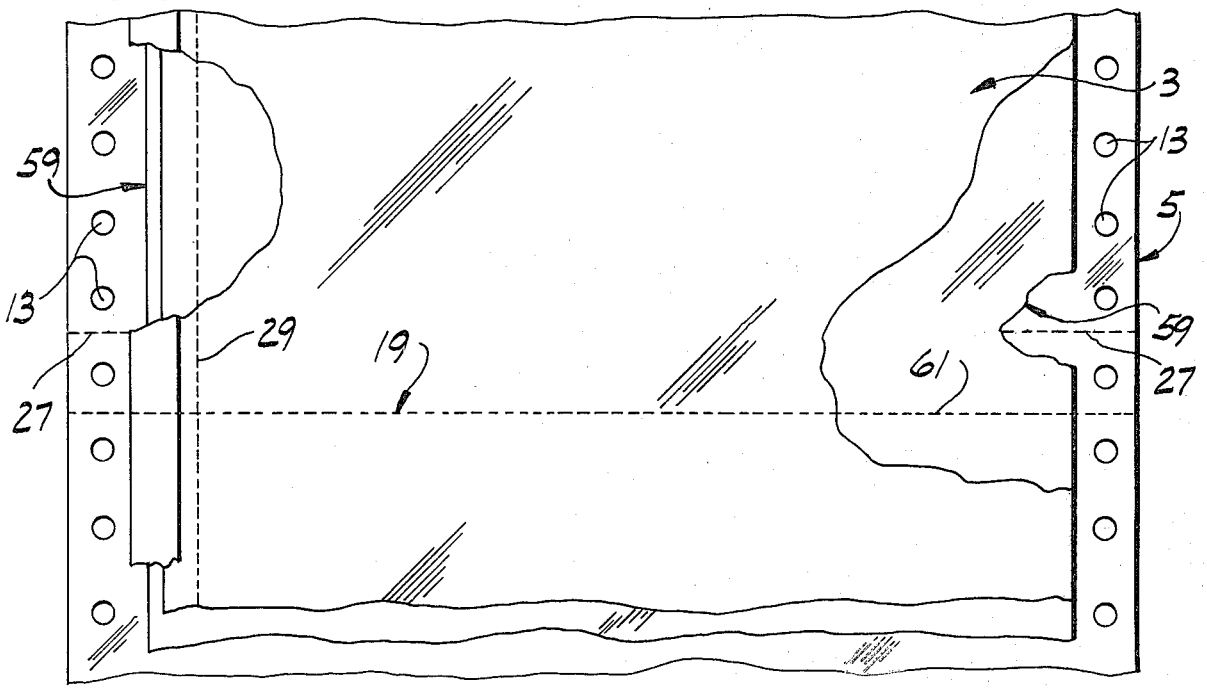
Figure 10:
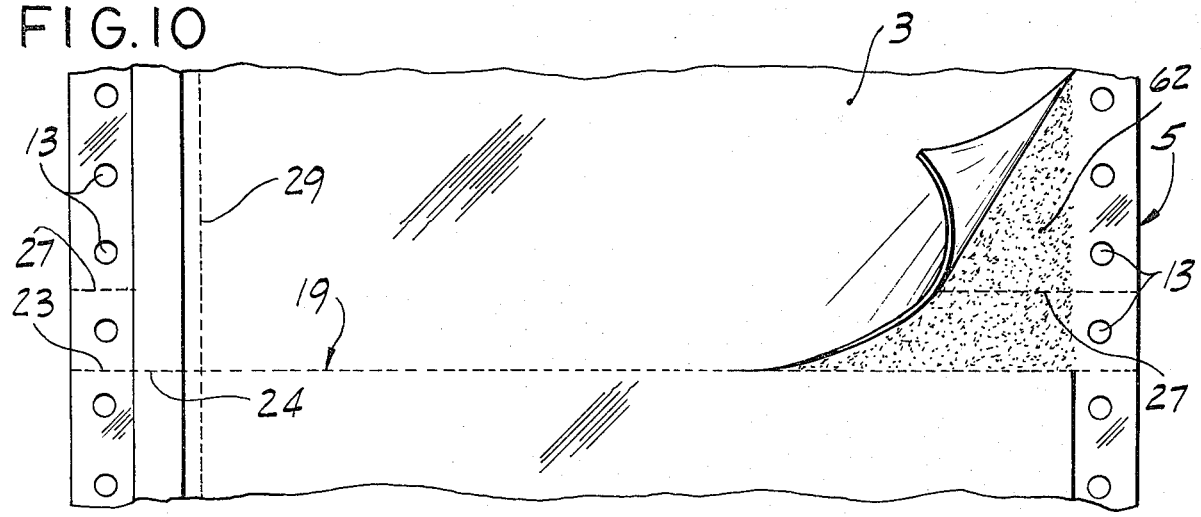

The continuous stencil assembly may have a printing transfer medium under the continuous stencil strip for effecting printing transfer to the stencil strip for proof reading, although this may not regarded as necessary. This may comprise a coating of carbon or the like on the back of the continuous stencil strip, as indicated at 57 in FIG. 8. Or it may comprise a continuous strip of carbon paper or the like as indicated at 59 in FIG. 9 between the stencil strip 3 and the carrier strip 5. This carbon paper strip has transverse lines of weakness, again preferably lines of perforations, as indicated at 61 generally in register with the lines of weakness of the first series 19 in the stencil and carrier strips. Or a printing transfer medium (e.g. a carbon coating) may be applied as indicated at 62 directly to the face of the carrier strip 5 underlying the stencil strip as illustrated in FIG. 10. Or no printing transfer medium may be used, relying on the carbon ribbon of an imprinting device to print on the stencil strip for proof reading.

Figure 11:
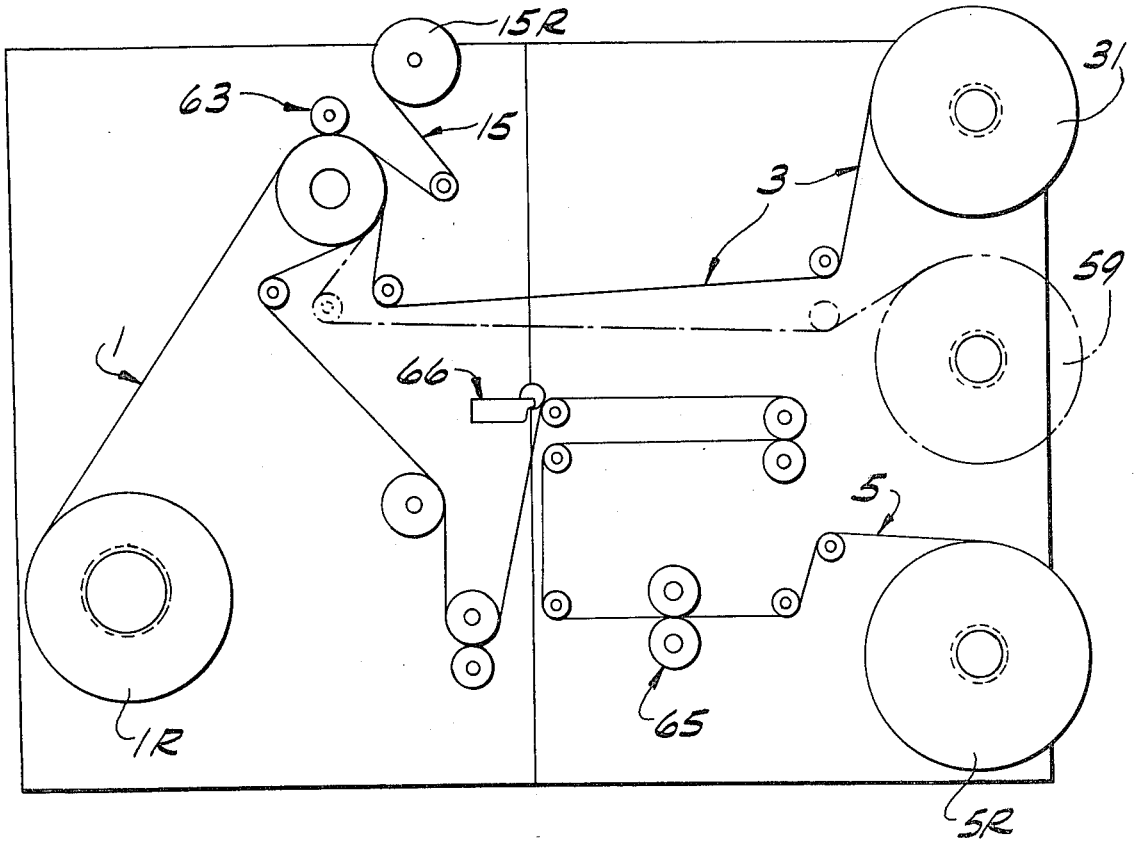
FIG. 11 is a view showing the manufacture of the continuous stencil assembly.

FIG. 11 shows a method of this invention for manufacturing the continuous stencil assembly 1, the method involving feeding forward the continuous stencil strip 3 from a supply roll 3R and feeding forward the continuous carrier strip 5 from a supply roll 5R, these strips being ultimately brought together at a set of combining and perforating rolls 63. As the carrier strip 5 is fed forward from roll 5R to the set of rolls 63, it passes through a set of perforating rolls 65 which function to form the lines of perforations 27 in the carrier strip, these lines extending transversely across the carrier strip from one side edge of the strip to the other and spaced longitudinally of the strip the stencil height H. At the set of rolls 63, the stencil strip 3 becomes applied to the upper face of the carrier strip in position between the series of holes 13 at the sides of the carrier strip. Tape 15 is fed forward from a supply roll 15R and brought together with the strips 3 and 5 at the set of rolls 63 overlying the one side margin of the strip 3 and adhered thereto and overlying and adhered to the carrier strip 5. Instead of using a tape for the securement, adhesive as indicated at 18 in FIG. 3A may be applied as by means of a roller in a fountain 66 as illustrated in FIG. 11, the adhesive being applied in a narrow continuous band or as a series of spaced dots. The set of rolls 63 also functions to form the lines of perforations at 19 in the two strips (including the lines 21 in the stencil strip, the lines 23 in the carrier strip, and the lines 24 across the tape 15). The phasing of the transverse perforating at 63 with respect to the transverse perforating at 65 is such as to achieve the offsetting of the lines 19 and 27. The completed continuous assembly 1 may then be wound up into a roll 1R (presumably it could be manifolded). At 59R in FIG. 10 is indicated a roll of carbon paper 59 which may be incorporated between strips 3 and 5. As to the FIG. 8 modification, the strip 3 will of course have been precoated on one face with carbon.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A continuous stencil assembly comprising, a continuous stencil strip of stencil material, a continuous carrier strip carrying the stencil strip, said stencil strip extending longitudinally of the carrier strip on one face of the carrier strip, the stencil strip and the carrier strip each having a first series of lines of weakness extending transversely thereof spaced at stencil height intervals along the length of the strips with each of said lines of weakness of the first series in the stencil strip at least generally in register with a respective line of weakness of the first series in the carrier strip, said strips being adapted to be torn on said lines of weakness of the first series for providing individual stencil assemblies each comprising the segment of the stencil strip and the segment of the carrier strip between two successive lines of weakness of the first series, the carrier strip further having a second series of lines of weakness extending transversely thereof spaced at intervals corresponding to the spacing of the lines of weakness of the first series but offset longitudinally of the strips from the lines of weakness of the first series, each line of weakness of the second series being adjacent one of the two successive lines of weakness of said first series in the carrier strip and between said two successive lines of weakness of said first series in the carrier strip, each individual stencil assembly, as torn from said continuous stencil assembly on the respective two successive lines of weakness of said first series, being of rectangular shape having transverse edges where torn at said two successive lines of weakness of the first series and end edges, and having a line of weakness of the second series in the segment of the carrier strip in said individual stencil assembly adjacent one of said transverse edges, and means securing the stencil strip to the carrier strip holding the said segments of the strips in each of said individual stencil assemblies together but with a portion of the carrier strip between the said line of weakness of the second series therein and the other of said transverse edges free of the segment of the stencil strip in the individual stencil assembly, thereby permitting securement to an imprinter of each individual stencil assembly along said one transverse edge thereof including both the carrier strip segment and the stencil strip segment of the individual stencil assembly and subsequent tearing away of the free portion of the carrier strip segment, leaving a portion of the carrier strip segment along said one transverse edge secured to the imprinter.

2. A continuous stencil assembly as set forth in claim 1 having a printing transfer medium under the continuous stencil strip.

3. A continuous stencil assembly as set forth in claim 2 wherein the transfer medium comprises a continuous strip of carbon paper or the like, the latter strip having transverse lines of weakness generally in register with the lines of weakness of the first series in the stencil and carrier strips.

4. A continuous stencil assembly as set forth in claim 2 wherein the transfer medium comprises carbon or the like coated on the back of the continuous stencil strip.

5. A continuous stencil assembly as set forth in claim 2 wherein the printing transfer medium is coated on the carrier strip.

6. A continuous stencil assembly as set forth in claim 1 wherein the continuous stencil strip is narrower than the carrier strip, the carrier strip having side margins extending laterally outwardly from under the stencil strip at both sides of the latter and each said side margin of the carrier strip having a series of holes therein.

7. A continuous stencil assembly as set forth in claim 6 wherein the stencil strip has side margins and said assembly has means securing the stencil strip along one side margin thereof to the carrier strip, said stencil strip and carrier strip each having a line of weakness extending longitudinally thereof spaced inwardly from and adjacent said securing means with said longitudinal lines of weakness at least generally in register, said longitudinal lines of weakness permitting tearing away of the portions of the stencil strip and the carrier strip of an individual stencil assembly which lie outward of said longitudinal lines of weakness.

8. A continuous stencil assembly as set forth in claim 7 wherein said securing means comprises an adhesive tape overlying the said one side margin of the stencil strip and adhered thereto and overlying and adhered to the carrier strip immediately outward of the respective edge of the stencil strip and inward of the adjacent series of holes on the carrier strip.

9. The method of making a continuous stencil assembly as set forth in claim 1 comprising feeding forward from respective supplies thereof a continuous stencil strip and a continuous carrier strip, bringing these strips together with the stencil strip extending longitudinally of the carrier strip on one face of the carrier strip, forming lines of weakness in the carrier strip as it is fed forward toward the stencil strip with these lines of weakness extending transversely of the carrier strip and spaced at stencil height intervals along the length of the carrier strip, these lines constituting the said second series of lines of weakness, and forming lines of weakness in the combined stencil and carrier strips with said lines extending transversely of the strips and also spaced at stencil height intervals but offset longitudinally from the lines of weakness of said second series in the carrier strip and constituting the said first series of lines of weakness, the stencil strip being secured to the carrier strip in the manner specified in claim 1 as the strips are brought together.

10. The method of claim 9 wherein the carrier strip has a series of holes at each of its side margins, the stencil strip is narrower than the distance between the two series of holes, and the strips are brought together as they are fed forward with the stencil strip between the two series of holes and the side margins of the carrier strip extending laterally outwardly from under the stencil strip at both sides of the latter.

11. The method of claim 10 wherein the stencil strip is secured along one side thereof to the carrier strip, and wherein a line of weakness is formed in the combined strips extending longitudinally thereof adjacent and on the inside of the securement at said one side.

12. The method of claim 11 wherein the securement is effected by feeding forward an adhesive tape and bringing it together with the strips overlying said one side of the stencil strip and adhered thereto and overlying and adhered to the carrier strip immediately outward of the respective edge of the stencil strip and inward of the adjacent series of holes on the carrier strip.

13. The method of claim 11 wherein the securement is effected by applying adhesive to the carrier strip as it is fed forward toward the stencil strip.

* * * * *